US005596187A

United States Patent [19]

Di Stefano et al.

[11] Patent Number: 5,596,187

[45] Date of Patent: Jan. 21, 1997

[54] OPTICAL METHOD FOR EXAMINING THE OPEN END OF A CIGARETTE TO DETERMINE ITS UNIFORMITY OF FILLING WITH TOBACCO

[75] Inventors: Giuseppe Di Stefano, Ferrara; Marco Ghini, Lazzaro Di Savena; Armando Neri; Antonio Gamberini, both of Bologna, all of Italy

[73] Assignee: G.D Societa' Per Azioni, Bologna, Italy

[21] Appl. No.: 266,176

[22] Filed: Jun. 27, 1994

[30] Foreign Application Priority Data

Jun. 28, 1993 [IT] Italy ..... B093A0297

[51] Int. Cl.[6] ..... G01V 9/04

[52] U.S. Cl. ..... 250/222.1; 250/559.45

[58] Field of Search ..... 250/222.1, 223 R, 250/221, 559.45, 559.22; 356/237, 445, 448; 209/536; 131/280, 281, 108, 902–907; 73/78, 821, 823

[56] References Cited

U.S. PATENT DOCUMENTS

| | | | |
|---|---|---|---|
| 3,812,349 | 5/1974 | Gugliotta | 250/223 R |
| 3,980,567 | 9/1976 | Benini | 250/223 R |
| 5,013,905 | 5/1991 | Neri | 250/223 R |
| 5,223,915 | 6/1993 | Neri | 356/237 |
| 5,235,649 | 8/1993 | Reda | 356/237 |

FOREIGN PATENT DOCUMENTS

| | | |
|---|---|---|
| 0370231 | 5/1990 | European Pat. Off. . |
| 0585686 | 9/1994 | European Pat. Off. . |
| 2312975 | 12/1976 | France . |
| 4000658 | 8/1990 | Germany . |
| 1112687 | 5/1968 | United Kingdom . |
| 2176598 | 12/1986 | United Kingdom . |

*Primary Examiner*—Que T. Le
*Attorney, Agent, or Firm*—Ladas & Parry

[57] ABSTRACT

The filling of a cigarette is controlled by detecting a brightness curve of at least one part of the open end of the cigarette, processing the resulting brightness curve to obtain a contrast index, and comparing the resulting contrast index with an equivalent index of a correctly filled cigarette to obtain a signal indicating acceptance of the cigarette under observation.

13 Claims, 3 Drawing Sheets

OPTICAL METHOD FOR EXAMINING THE OPEN END OF A CIGARETTE TO DETERMINE ITS UNIFORMITY OF FILLING WITH TOBACCO

BACKGROUND OF THE INVENTION

The present invention relates to a cigarette filling optical control method.

More specifically, the present invention relates to a method of controlling the conformation of the open end of cigarettes and, in particular, the presence or absence of tobacco at the open end, on a cigarette manufacturing machine and/or filter assembly machine and/or packing machine.

At the output of a cigarette manufacturing machine and/or filter assembly machine and/or at the input of a packing machine, the cigarettes are normally subjected to numerous checks comprising a check of the filling to determine the presence or absence of tobacco at the open end of the cigarettes.

In most cases, filling control consists in illuminating the front surface of the open end of the cigarette by means of a light source; forming an image of the front surface by means of a detecting unit featuring a telecamera or equivalent optical monitoring system; and transmitting the image to a comparing unit for comparing it with a specimen image and emitting a reject signal in the event the detected and specimen images differ over and above a given limit.

In general, the difference in the detected and specimen images depends on differences in shading which, as is known, varies according to the presence of gaps on the front surface due to the absence of tobacco. Unfortunately, the shading of the detected image has been found to depend largely, not only on the presence of gaps, but also on the color of the tobacco employed, so that known devices of the above type involve expensive, time-consuming setup procedures whenever the type of tobacco is changed.

SUMMARY OF THE INVENTION

It is an object of the present invention to provide a straightforward, low-cost optical control method designed to overcome the aforementioned drawbacks.

According to the present invention, there is provided a cigarette filling optical control method, comprising the steps of detecting at least one brightness curve of at least one part of the open end of the cigarette under observation; processing the brightness curve to obtain an index, preferably a contrast index; and comparing the resulting index with an equivalent predetermined index to obtain a signal indicating acceptance of the cigarette under observation.

The brightness curve is preferably processed by means of a differentiating block, the output signal of which, corresponding to a contrast curve, is further processed to obtain said contrast index.

According to a preferred embodiment of the above method, the brightness curve is detected by means of an optical device having a reference plane consisting of a fixed plane for focusing the optical system itself; the method preferably comprising a further step of mechanically or electrically controlling the position of the cigarette under observation in relation to the reference plane.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
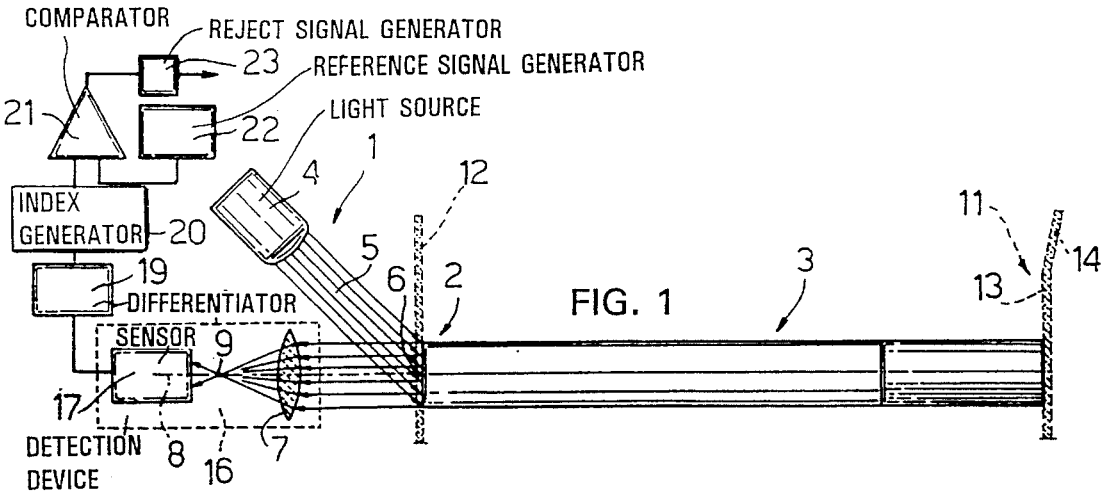
FIG. 1 shows a preferred embodiment of the optical device according to the present invention.

Numeral 1 in FIG. 1 indicates an optical device for controlling the filling of the open end portion 2 of a cigarette 3.

Figure 2A:
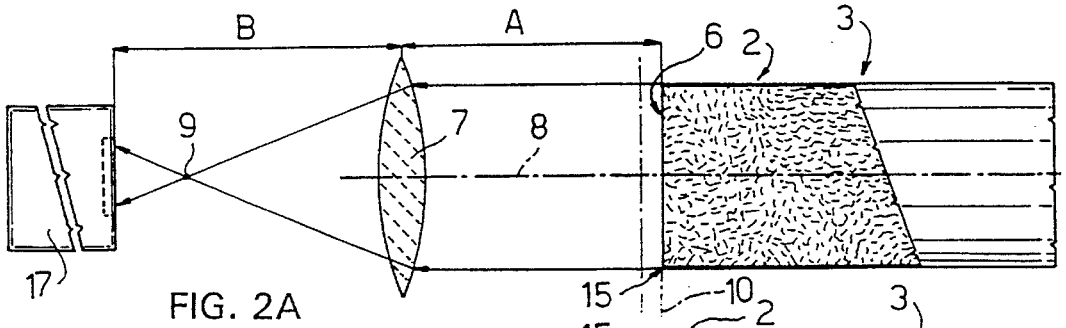
FIGS. 2*a*and 2*b* are partial views of the FIG. 1 device in two different operating conditions.
Figure 2B:
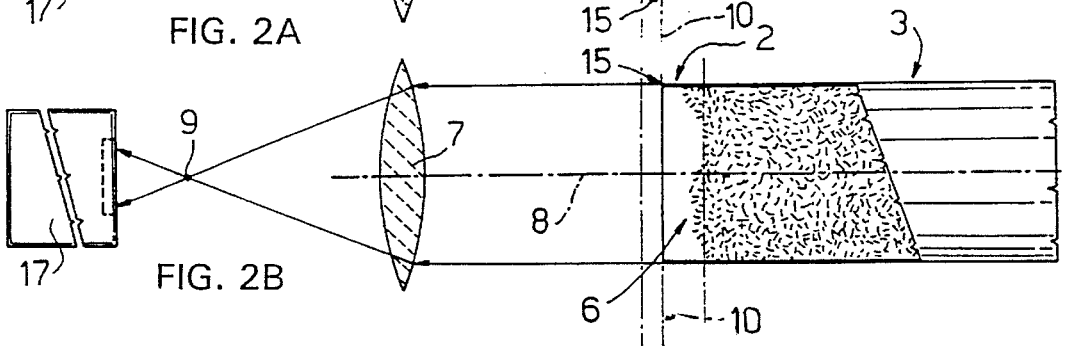

Device 1 comprises a light source 4 for emitting a light beam 5 impinging on and illuminating the front end surface 6 of portion 2; and a biconvex lens 7 having an optical axis 8 and a fixed focus 9. As shown in FIGS. 2*a*and 2*b*, device 1 has a reference plane consisting of a fixed focusing plane 10 at a given distance A from lens 7, and a substantially zero depth of field.

As shown in FIG. 1, cigarette 3 is preferably, but not necessarily, engaged by a mechanical guide device 11 defined by a front and rear wall 12, 13 parallel to plane 10, and along which each cigarette 3 is fed transversely by a known conveyor device (not shown) into a control position coaxial with axis 8. Wall 12 is made of transparent material with an inner surface coincident with plane 10; and wall 13 is separated from wall 12 by a distance approximately equal to but not less than the length of cigarette 3, and has a lead-in portion 14 for exerting axial thrust on cigarette 3, as this is fed into said control position, so that the annular front end edge 15 defined by the wrapping paper of cigarette 3 is positioned tangent to plane 10.

Figure 3:
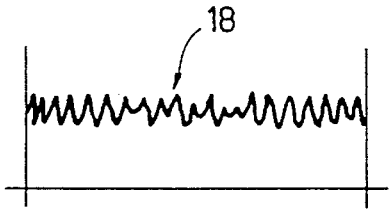
FIG. 3 shows a working diagram of a brightness curve detected by means of the FIG. 1 optical device.

Lens 7 forms part of a detecting device 16 which also comprises a sensor 17 located along axis 8, on the side of focus 9 to lens 7, on the opposite side of lens 7 opposite cigarette 3, and at a given distance B (FIGS. 2*a*and 2*b*) from lens 7, for supplying in known manner a brightness curve 18 (FIG. 3) relative to at least part of the image of surface 6 observed through lens 7. Sensor 17 may consist of a CCD sensor, or one or more linear sensors for analyzing fixed linear portions of tobacco-filled surface 6, i.e. the surface within edge 15.

Device 1 also comprises a conventional differentiating block 19 for processing curve 18 to obtain a contrast curve (not shown) which is in turn processed by a conventional index generating block 20 to obtain a contrast index of the image observed by sensor 17. In a conventional comparing block 21, the resulting contrast index is compared with a reference index (e.g. the mean contrast index of the last 1000 cigarettes 3 examined) supplied to block 21 by a reference signal generator 22, to obtain a signal which is sent to a reject signal generator producing 23 for a reject signal in the event the contrast index of cigarette 3 and said reference index differ by an amount greater than a predetermined value.

Figure 4:
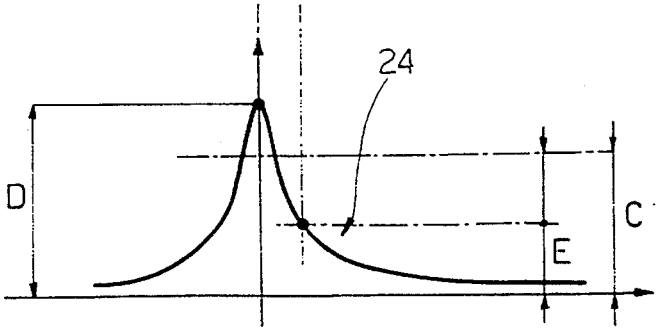
FIG. 4 shows a further working diagram of the contrast index curve formed by processing the FIG. 3 curve.

In actual use—and with reference to the FIG. 4 curve 24 showing the variation in the contrast index relative to variation in the distance of surface 6 from focusing plane 10—when end portion 2 is completely and properly flat, i.e. surface 6 is a flat surface coplanar with edge 15 and plane 10 (FIG. 2*a*), block 20 emits a signal corresponding to a maximum value D of the contrast index. The same does not apply, however, in the event portion 2 presents gaps (FIG. 2*b*) so that surface 6 is no longer coplanar with edge 15 and plane 10. In this case, in fact, as device 1 presents a substantially zero depth of field, the signals emitted by block 20, and indicating the value of the contrast index, indicate a reduction in the contrast index (curve 24) in direct proportion to the distance between surface 6 and plane 10. If C is the reference index value, circuit 23 emits a reject signal when the difference between value C and the detected value E exceeds a predetermined amount.

Figure 5:
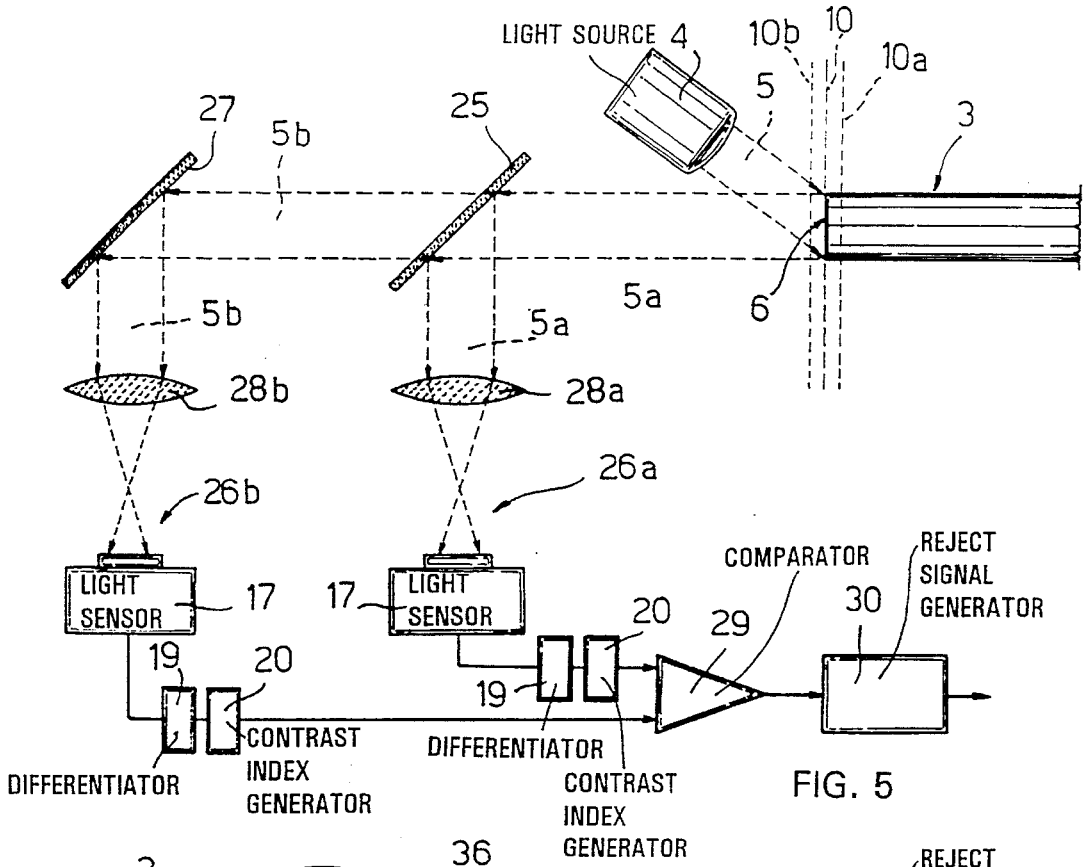
FIG. 5 shows a schematic view of a variation of the FIG. 1 optical device.

In the FIG. 5 variation, the beam 5 emitted by source 4 and reflected by surface 6 is directed onto a semireflecting mirror 25 which reflects a first portion of beam 5 to form a beam 5*a* directed towards a first optical device 26*a*, and lets through a second portion of beam 5 to define a beam 5*b* which is directed by a fully reflecting mirror 27 towards a second optical device 26*b*.

Optical devices 26*a*, 26*b* are substantially similar to device 1, and comprise respective focusing lenses 28*a*, 28*b* similar to lens 7 and having respective fixed focusing planes 10*a*, 10*b* on either side of and symmetrical in relation to a reference plane 10. Plane 10, which defines the correct plane of edge 15 of cigarette 3, may therefore be said to be equally out of focus in relation to lenses 28*a*, 28*b*.

Like device 1, devices 26*a*, 26*b* comprise respective sensors 17, respective differentiating blocks 19, and respective contrast index generating blocks 20, the output signals of which are supplied to a comparing block 29. The output signal of block 29 presents a value depending on the difference between said two indexes, and is supplied to a reject signal generator 30 for emitting a reject signal when said output signal exceeds a given value. That is, if surface 6 is substantially coplanar with edge 15 and hence with plane 10, the two output signals from blocks 20 cancel each other out, whereas if surface 6 is not coplanar with edge 15 an output signal from block 29 is produced which increases in proportion to the amount by which surface 6 is shifted, in relation to plane 10, towards one or other of planes 10*a*, 10*b*.

The signals supplied by devices 1 and 26 are obviously only effective in producing a reliable reject signal if the front edge 15 of cigarette 3 does in fact lie in plane 10, which is definitely assured if provision is made for mechanical guide device 11, as is normally the case on a packing machine, or for other means of maintaining cigarette 3 in the correct observation position described above. In some cases, however, cigarettes 3 fail to assume the correct observation position and are shifted axially in relation to the correct observation position by varying amounts.

Figure 6:
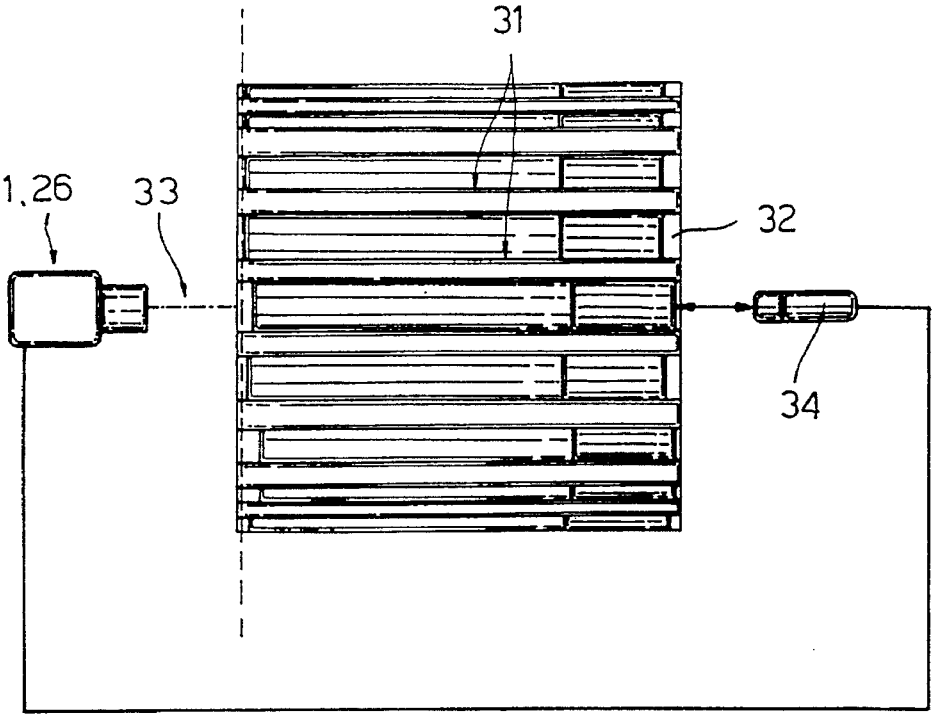
FIGS. 6 and 7 show schematic views of a first and second perfected embodiment of the optical devices in FIGS. 1 and 5.
Figure 7:
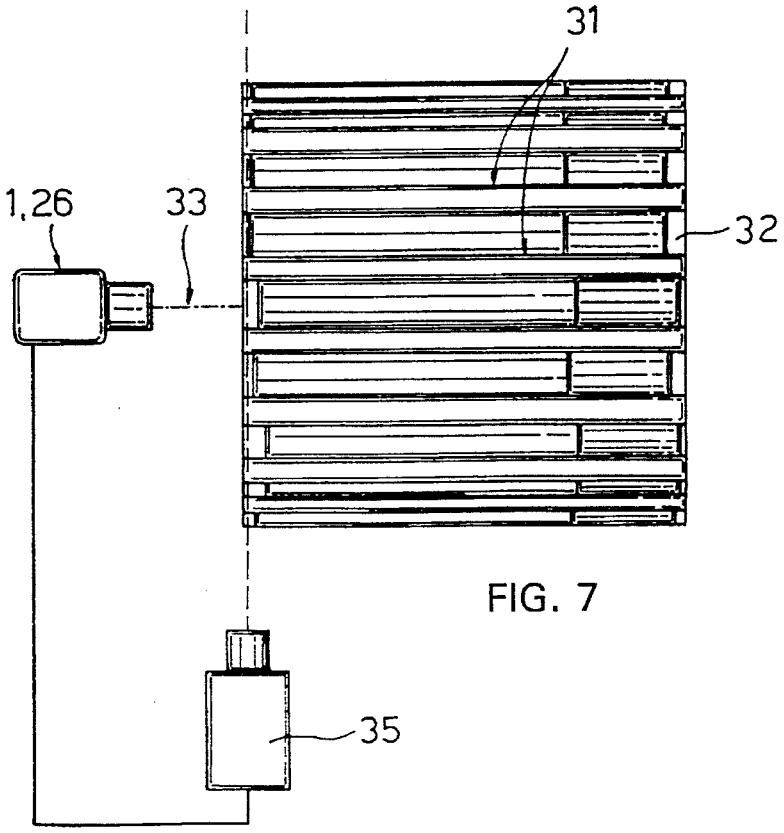

Such, for example, is the case shown in FIGS. 6 and 7 wherein cigarettes 3 are retained by suction, in varying axial positions, inside respective seats 31 on the outer periphery of a feed roller 32, e.g. of a filter assembly machine, and are fed successively by roller 32 through a control station 33 equipped with an optical control device 1, 26. In this case, optical device 1, 26 is associated with a position detector consisting, in the FIG. 6 case, of a fixed rear detector 34 for detecting the distance between itself and the end of cigarette 3 opposite portion 2, and, in the FIG. 7 case, of a lateral detector 35 for detecting the position of the plane of edge 15 of cigarette 3. The signal emitted by detector 34, 35 is sent to block 20 (or blocks 20) of device 1 (or devices 26) to permit block 20 (or blocks 20) to emit a signal corrected according to the distance between the plane of edge 15 of cigarette 3 and plane 10.

Figure 8A:
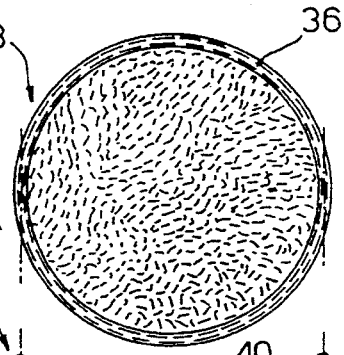
FIG. 8 shows a working diagram of an alternative brightness curve detected by means of the FIG. 1 optical device.
Figure 8B:
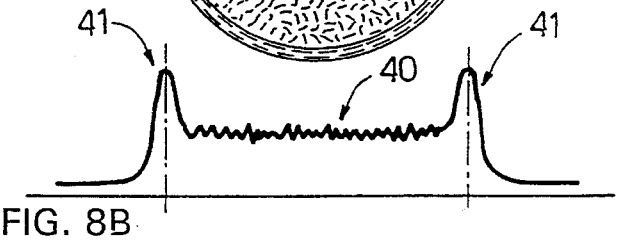
Figure 8C:
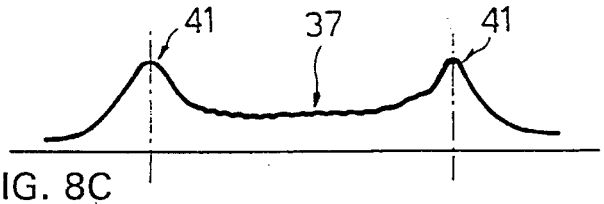

As shown in FIG. 8, detector 34, 35 may be dispensed with by extending the observation range of sensor 17 to edge 15 and hence to the outer paper layer 36 of cigarette 3, and by processing brightness curve 37, supplied by sensor 17, differently as compared with FIG. 1.

Figure 9:
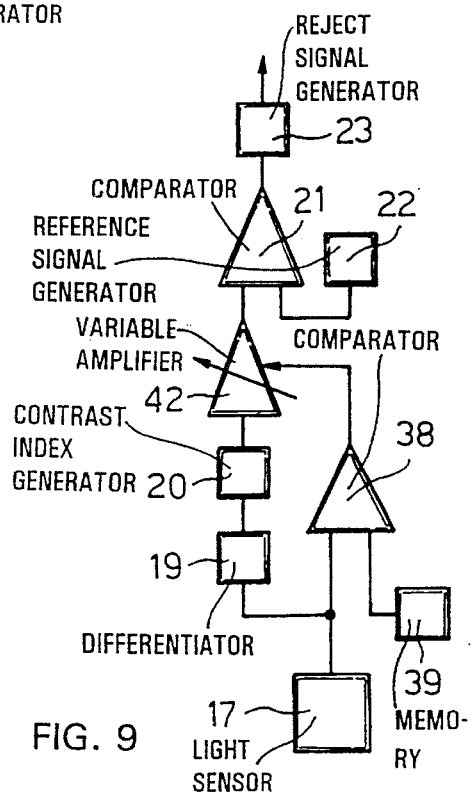
FIG. 9 shows a variation of a portion of FIG. 1, relative to an optical device employing the FIG. 8 brightness curve.

More specifically, and with reference to FIG. 9, the curve 37 signal is sent to differentiating block 19 and hence index generating block 20, as well as in parallel manner to a comparing block 38 which is supplied by a memory 39 with a signal due to a correct brightness curve 40 (FIG. 8).

At the points at which the observation line intersects edge 15, curve 40 presents two peaks 41 related to detection of paper layer 36. Since peaks 41 are related to the detection of white points in plane 10, identical peaks 41 should be present in any curve 37 related to a cigarette 3 whose edge 15 lies in plane 10. If they are not, this means edge 15 is shifted in relation to plane 10 by an amount the value of which is indicated by an output signal of block 38; which output signal is used to drive a variable-gain amplifier 42 interposed between the output of block 20 and the input of block 21, for supplying block 21 with a modified contrast index to eliminate the error due to the shift in edge 15 in relation to plane 10.

What is claimed is:

1. An optical method for evaluating uniformity of tobacco filling a cigarette, said method comprising:

directing a beam of light against an open end of a cigarette to illuminate tobacco in said cigarette at said open end, reflecting said beam of light from the tobacco at said open end of the cigarette through a fixed focus lens, having zero depth of field, onto an image plane at which an image is formed of the tobacco illuminated by reflecting of said beam, producing a curve representative of variation of brightness in said image plane, of said image along said open end of the cigarette as a function of proximity of the tobacco at said open end with respect to a reference plane, processing said brightness curve to obtain an index value representative of said brightness and thereby of uniformity of filling of said cigarette with tobacco at said open end, and comparing said index value with a reference index value to determine acceptance or not of the uniformity of filling of said cigarette with tobacco at said open end.

2. The method as claimed in claim 1, wherein said index value obtained by processing said brightness curve is a contrast index.

3. The method as claimed in claim 2, wherein said processing of said brightness curve comprises differentiating said brightness curve to produce a contrast curve and processing said contrast curve to obtain said contrast index.

4. The method as claimed in claim 1, wherein said fixed focus lens has a fixed focussing plane at which said open end of the cigarette is placed.

5. A method as claimed in claim 4, comprising placing an optical sensor at said image plane to produce said brightness curve based on light reflected at said open end of said cigarette end focussed by said fixed focus lens on said image plane.

6. A method as claimed in claim 1, comprising providing a second fixed focus lens receiving reflected light from said open end of the cigarette end and forming a second image of the open end of the cigarette to produce a second brightness curve, and positioning the first and second lenses such that respective, fixed, focussing planes of said first and second lenses are symmetrically positioned on opposite sides of said reference plane.

7. A method as claimed in claim 6, comprising producing a second index value from said second brightness curve by processing said second brightness curve, and utilizing said second index value as said reference index value to which said index value produced from said first lens is compared.

8. A method as claimed in claim 4, further comprising positioning the cigarette with reference to said reference plane.

9. A method as claimed in claim 8, comprising axially displacing said cigarette to position said open end of the cigarette in said reference plane.

10. A method as claimed in claim 8, comprising detecting the open end of the cigarette relative to said reference plane.

11. A method as claimed in claim 10, comprising modifying said index value of the brightness as a function of said open end of said cigarette with respect to said reference plane.

12. A method as claimed in claim 10, wherein the detecting of said open end of the cigarette relative to said reference plane is effected by electronically sensing a position of said open end of the cigarette with respect to said reference plane.

13. A method as claimed in claim 10, wherein the detecting of the open end of the cigarette comprises obtaining two peaks in the brightness curve reflected by light directed onto white paper of the cigarette surrounding the tobacco, and comparing the values of said two peaks.

* * * * *